US009186038B2

(12) United States Patent
Bastuji

(10) Patent No.: US 9,186,038 B2
(45) Date of Patent: Nov. 17, 2015

(54) DISHWASHER

(75) Inventor: Ismail Cem Bastuji, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1319 days.

(21) Appl. No.: 13/056,939

(22) PCT Filed: Jul. 7, 2009

(86) PCT No.: PCT/EP2009/058613

§ 371 (c)(1),
(2), (4) Date: Apr. 28, 2011

(87) PCT Pub. No.: WO2010/012572

PCT Pub. Date: Feb. 4, 2010

(65) Prior Publication Data

US 2011/0193457 A1 Aug. 11, 2011

(30) Foreign Application Priority Data

Jul. 31, 2008 (TR) ..... A 2008/05662

(51) Int. Cl.
*A47L 15/50* (2006.01)
*A47B 88/04* (2006.01)

(52) U.S. Cl.
CPC ..... *A47L 15/502* (2013.01); *A47L 15/507* (2013.01); *A47B 2088/0429* (2013.01); *A47B 2088/0448* (2013.01); *A47B 2210/0024* (2013.01); *A47B 2210/17* (2013.01)

(58) Field of Classification Search
CPC ..... A47B 2210/0062; A47B 2210/0059; A47B 2210/0024; A47B 2210/0002; A47B 2210/05; A47B 2210/15; A47B 2210/17; A47B 2210/0083; A47B 88/0455; A47B 2088/0448; A47B 208/04298; A47B 2210/04; A47L 15/502; A47L 15/507
USPC ..... 126/339; 312/311, 408; 211/133.15, 211/126.15; 134/56 D, 135
See application file for complete search history.

(56) References Cited

U.S. PATENT DOCUMENTS

| | | | | |
|---|---|---|---|---|
| 1,014,020 | A * | 1/1912 | Miller | 211/94.01 |
| 1,973,416 | A * | 9/1934 | Otte | 108/143 |
| 2,033,860 | A * | 3/1936 | Otte | 312/408 |
| 2,033,861 | A * | 3/1936 | Otte | 312/408 |
| 2,946,458 | A * | 7/1960 | Miller et al. | 211/88.01 |
| 3,466,109 | A * | 9/1969 | Kauffman et al. | 312/228.1 |
| 3,556,625 | A * | 1/1971 | Kauffman | 312/301 |
| 4,825,504 | A * | 5/1989 | Camilleri | 16/108 |
| 5,934,486 | A * | 8/1999 | Jarvis et al. | 211/41.8 |
| 6,643,900 | B2 * | 11/2003 | Jahrling | 24/563 |
| 7,455,066 | B2 * | 11/2008 | Feddema et al. | 134/56 D |
| 2005/0241682 | A1 * | 11/2005 | Jeong et al. | 134/56 D |
| 2006/0219271 | A1 * | 10/2006 | Feddema et al. | 134/56 D |
| 2012/0062085 | A1 * | 3/2012 | Bastuji et al. | 312/228.1 |

* cited by examiner

*Primary Examiner* — Joseph L Perrin
*Assistant Examiner* — Kevin G Lee
(74) *Attorney, Agent, or Firm* — Venjuris P.C.

(57) ABSTRACT

The present invention relates to a dishwasher (1) that comprises a body (2), a door (3) allowing access into the body (2), at least two hangers (4) secured oppositely on the ceiling (T) of the body (2), at least two rails (5) each secured to the hangers (4) and at least one drawer (6) installed to the rails (5) from the opposite sides to be movable thereon, wherein the items to be washed are emplaced.

11 Claims, 6 Drawing Sheets

DISHWASHER

Figure 1:
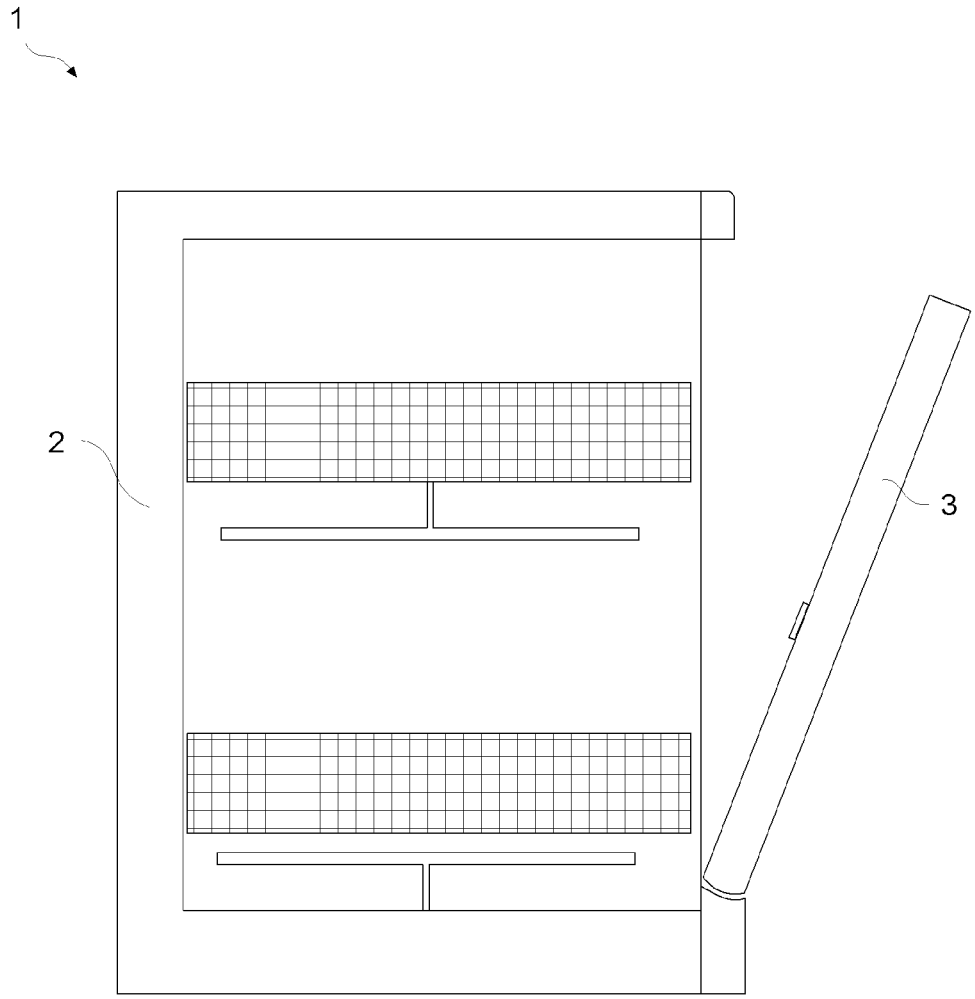

The present invention relates to a dishwasher that comprises a drawer wherein items to be washed are emplaced.

In dishwashers, drawers disposed close to the ceiling are used in addition to the baskets wherein items to be washed are emplaced for effective utilization of the washing space. The drawers are generally suitable for placing long and thin items such as cutlery and provide to utilize the dead space inside the washing chamber. In implementations known in the technique, the drawers are opened and closed by moving on setups such as rails, guides etc. mounted on the portions of the side walls close to the ceiling.

In order to solve this problem, in the state of the art United States of America patent application no US2005241682, a dishwasher is described that comprises guide rails mounted to the ceiling and a top rack disposed to be movable in front and rear directions at a position close to the ceiling. However, in this implementation the back and forth motion of the top rack is limited by the rails. The top rack cannot be pulled forward to be entirely out of the body hence the rear portions of the top rack cannot be used effectively.

The aim of the present invention is the realization of a dishwasher comprising a drawer that increases the loading capacity by allowing effective utilization of the interior volume.

The dishwasher realized in order to attain the aim of the present invention is explicated in the attached claims.

The dishwasher of the present invention comprises at least two hangers secured oppositely to the ceiling of the body, at least one drawer wherein the items to be washed are emplaced and

- at least two rails made of wires, configured in a reclining U shape, having a hanger arm, fixed to the hanger, extending parallel to the ceiling from the front backwards and
- a drawer arm, parallel and in the same direction as the hanger arm whereon the drawer is movably fitted.

The hanger arm and the drawer arm form two separate movement lines whereon the rail and the drawer move respectively. Thus, while the drawer slides on the drawer arm when the drawer is pulled, the rail slides on the hanger by means of the hanger arm. In other words, the rail moves with respect to the dishwasher and the drawer moves with respect to the rail. This two stage movement maintains the drawer to get entirely out of the dishwasher when pulled thereby allowing the user to easily load and unload the drawer and the rear portions of the drawer to be used more effectively.

The hanger comprises at least one tab so that the hanger arm can be mounted movably. The hanger arm is fitted into the tab and slides back and forth during the movement of the rail in the tab with respect to the dishwasher.

The hanger furthermore comprises at least one stopper disposed virtually opposite the tab. The stopper guides the movement during the motion of the rail inside the tab and prevents the rail being dislodged from the tab.

The drawer comprises:

- at least one casing in the form of a frame and preferably made of wires,
- at least two retainers which are configured as a connection member, having at least one channel enabling the drawer arm to be slidably emplaced therein,
- at least one carrier, forming the base of the casing, having hooks allowing to be suspended from the casing from two, opposite sides and
- at least one chamber, configured as an open-top box, emplaced on the carrier and wherein the items to be washed are placed.

The channel is like a tunnel through which the drawer arm passes. In this embodiment, for the assembly of the rail and the drawer, firstly the drawer arm is inserted from one end into the channels. In this position, the hanger arm is disposed on the walls of the channel. Afterwards, the hanger arm is placed inside the tabs on the hangers from the open end and the assembly is completed.

The dishwasher furthermore comprises at least one lid that covers the open ends of the hanger arm and the drawer arm. The lid prevents the rail being dislodged from the channel and the tab when the drawer is pulled to the end limit. The lid is removably mounted on the said ends and the drawer can be entirely taken out of the dishwasher when the lid is removed.

The retainer comprises at least one housing for affixing thereof on the casing.

The casing is produced by joining the bent wires. In this embodiment, the housing is such that at least one of the wires forming the casing is surrounded partially from the sides, enabling the retainer to be secured on the casing. The wire of the casing is preferably fitted inside the housing by close-fitting.

The retainer comprises at least one support that supports the drawer arm from below and helps the drawer arm to be balanced while the rail slides inside the channel.

The carrier is configured by joining the bent wires placed widthwise and lengthwise. The wires that are placed lengthwise and that traverses the base from end to end, are bend such that they extend towards the side walls and the front wall of the chamber. Hooks are provided at the ends of these wires. The carrier is suspended from the frame by means of these hooks. In this position, the carrier is like a swing between the front and rear walls of the frame. The chamber is emplaced on the base of the carrier and is supported by the widthwise and lengthwise wires on the base.

In this embodiment, the chamber comprises at least one lock wherein one of the carrier wires is seated. Accordingly, the chamber is robustly secured on the carrier.

By means of the present invention, the drawer that is mounted to the dishwasher ceiling can be pulled out entirely by sliding on the rail during utilization in an easy and effective manner. Thus, the space of the drawer and hence the dishwasher can be used effectively.

The model embodiments relating to the dishwasher realized in order to attain the aim of the present invention is illustrated in the attached figures, where:

FIG. 1—is the perspective view of a dishwasher.

Figure 2:
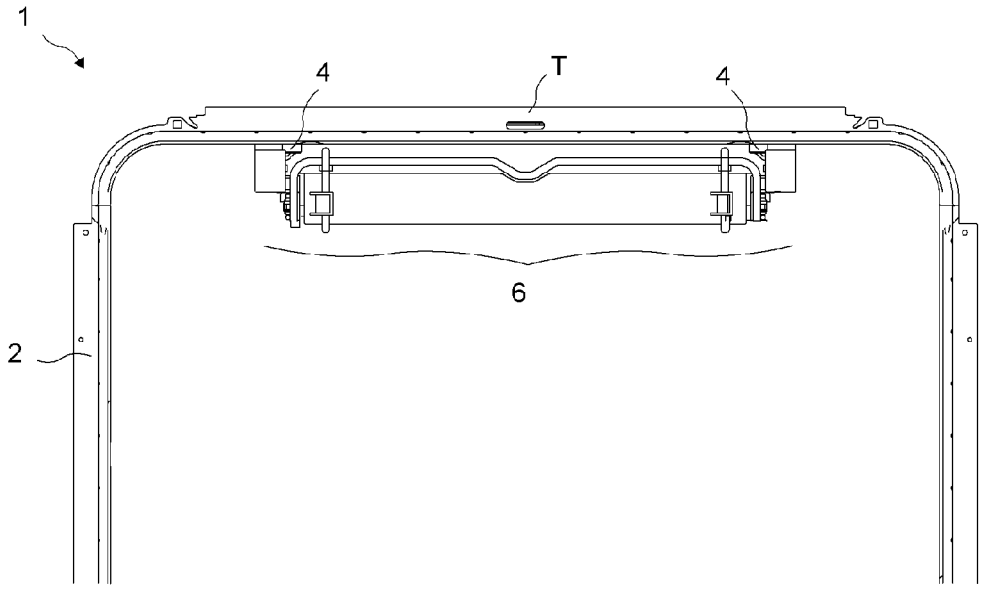

FIG. 2—is the front view of a dishwasher when the drawer is mounted.

Figure 3:
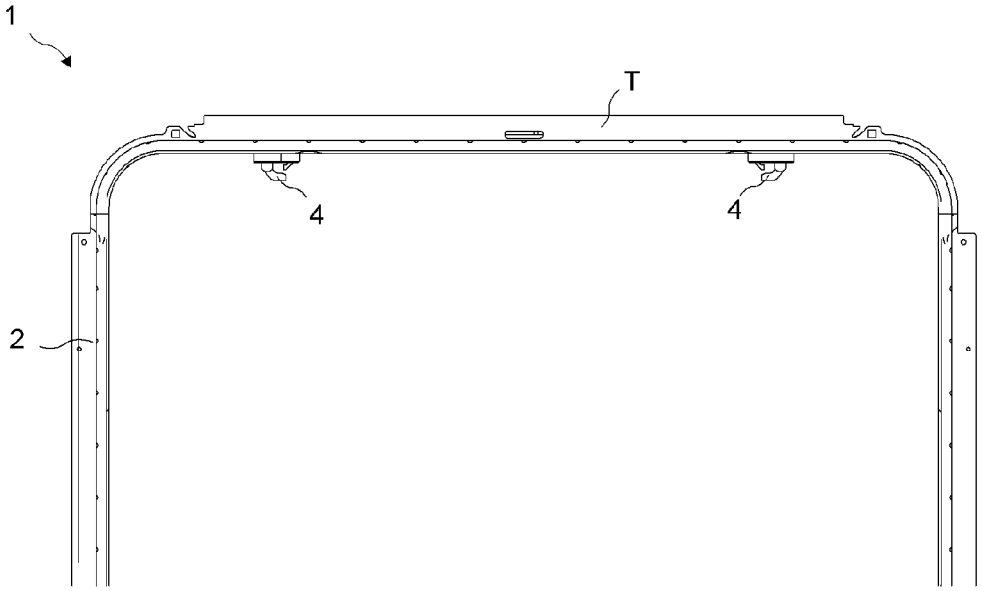

FIG. 3—is the front view of a dishwasher when the drawer is not mounted.

Figure 4:
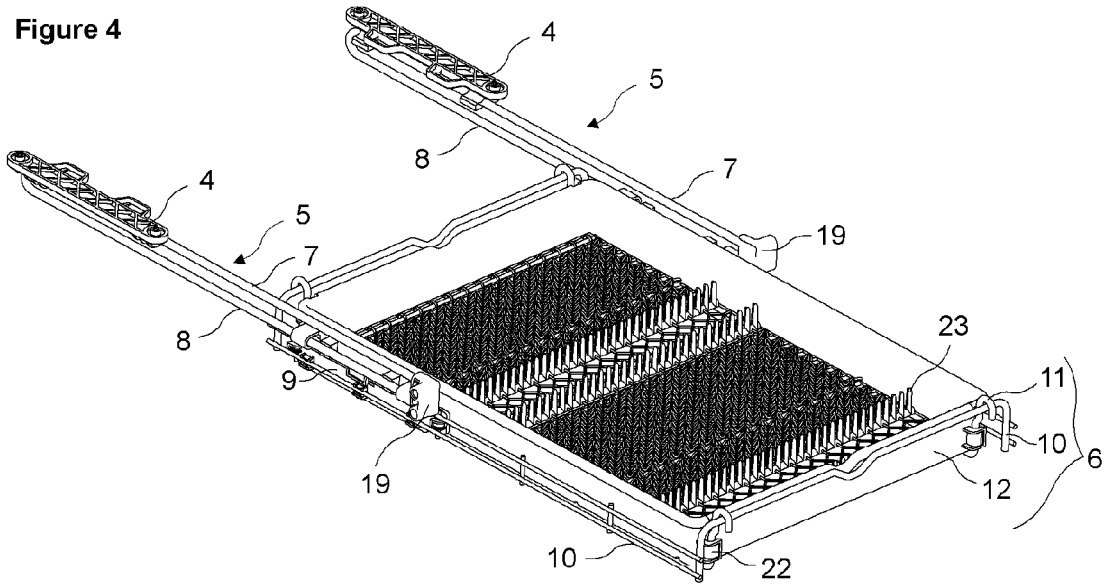

FIG. 4—is the perspective view of a drawer, a hanger and the rail.

Figure 5:
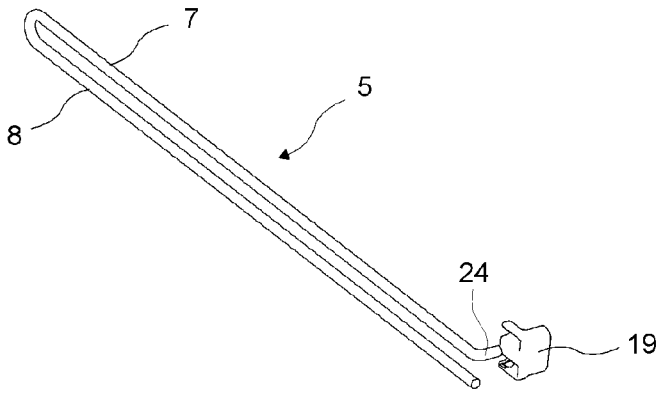

FIG. 5—is the perspective view of a rail and a lid.

Figure 6:
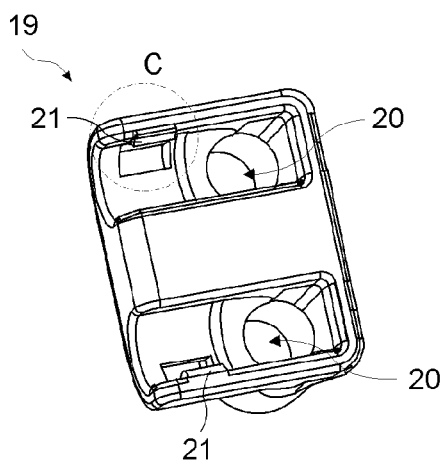

FIG. 6—is the front perspective view of a lid.

Figure 7:
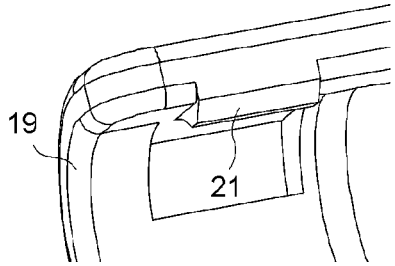

FIG. 7—is the view of detail C in FIG. 6.

Figure 8:
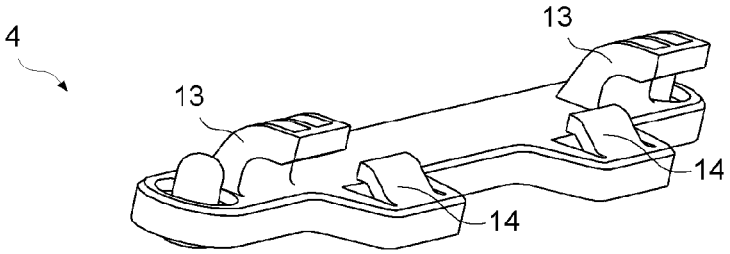

FIG. 8—is the perspective view of a hanger.

Figure 9:
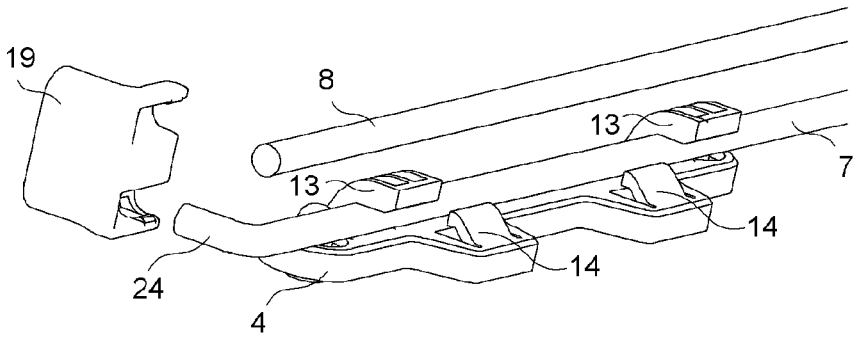

FIG. 9—is the perspective detailed view of a hanger, rail and lid.

Figure 10:
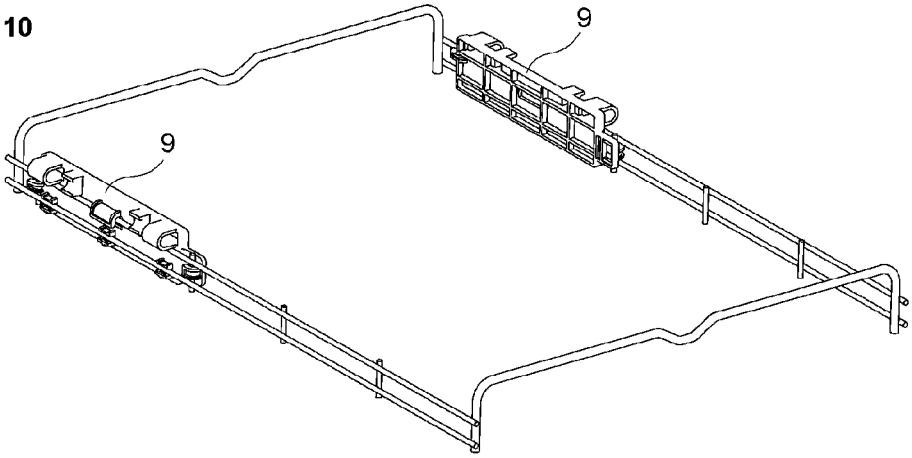

FIG. 10—is the perspective detailed view of a casing and the retainer.

Figure 11:
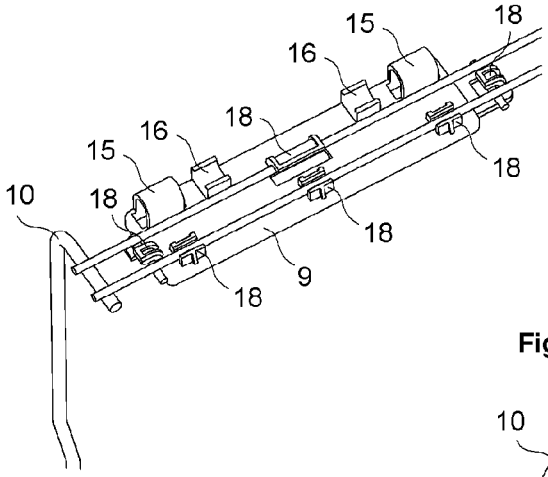

FIG. 11—is the bottom perspective detailed view of a casing and a retainer.

Figure 12:
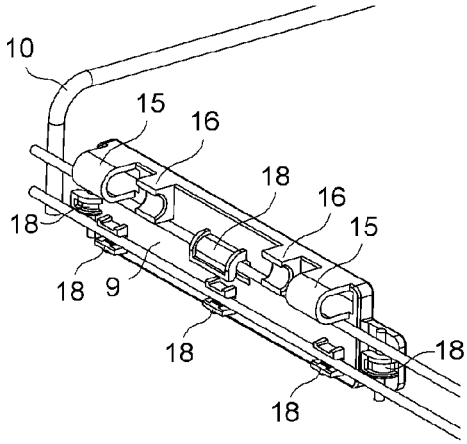

FIG. 12—is the side perspective detailed view of a casing and a retainer.

Figure 13:
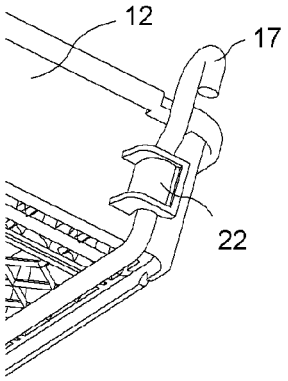

FIG. 13—is the perspective detailed view of a carrier and a chamber.

Figure 14:
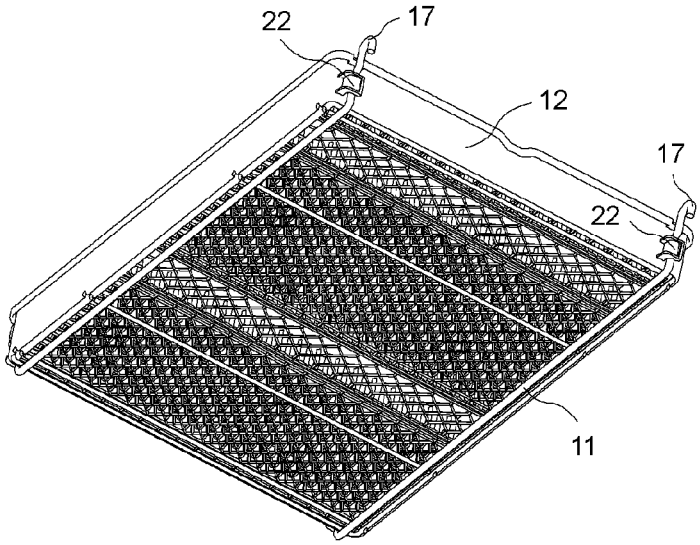

FIG. 14—is the perspective view of a carrier and a chamber.

Figure 15:
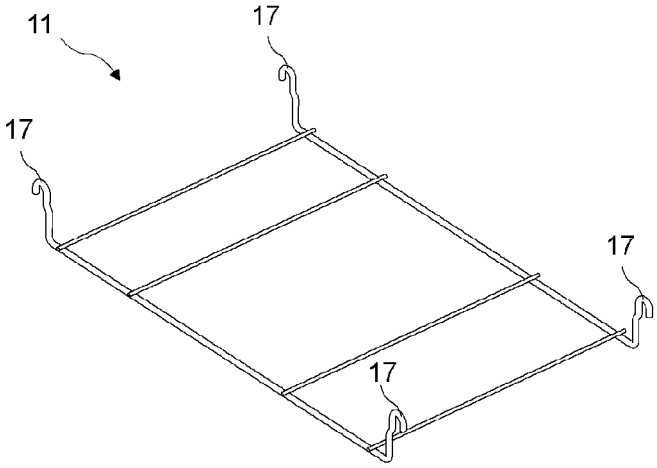

FIG. 15—is the perspective view of a carrier.

The elements illustrated in the figures are numbered as follows:

1. Dishwasher
2. Body
3. Door
4. Hanger
5. Rail
6. Drawer
7. Hanger arm
8. Drawer arm
9. Retainer
10. Casing
11. Carrier
12. Chamber
13. Tab
14. Stopper
15. Channel
16. Support
17. Hook
18. Housing
19. Lid
20. Recess
21. Protrusion
22. Lock
23. Fin
24. Extension The dishwasher (1) comprises a body (2), a door (3) allowing access into the body (2), at least two hangers (4) secured oppositely on the ceiling (T) of the body (2), at least one rail (5) mounted to the hangers (4) and at least one drawer (6) secured to the rails (5) from the opposite sides to be movable thereon, wherein the items to be washed are emplaced (FIG. 1, FIG. 2 and FIG. 3).

The rail (5) is formed as a thin, long rod and is shaped like a decumbent U, comprising a hanger arm (7) that extends parallel to the ceiling (T) from the front to the rear and a drawer arm (8) extending parallel to the hanger arm (7) in the same direction. The hanger arm (7) is affixed to the hanger (4) and enables the rail (5) to move to and fro on the hanger (4). On the other hand the drawer (6) is mounted on the drawer arm (8) and the drawer arm (8) enables the drawer (6) to move to and fro on the rail (5) (FIG. 4 and FIG. 5).

The drawer (6) when pulled to the front by the user, moves by sliding on the drawer arm (8) and comes forward. In the meantime, the rail (5) also moves as a result of the hanger arm (7) sliding on the hanger (4) and the drawer (6) can be pulled to the front such that it entirely projects out of the dishwasher (1) (FIG. 4).

In the preferred embodiment of the present invention, the drawer (6) comprises at least one retainer (9) that is movably secured on the drawer arm (8) allowing the drawer (6) to be affixed to the rail (5).

The hanger (4) furthermore comprises at least one tab (13) that supports the hanger arm (7) slidingly by at least partially clasping thereof and at least one stopper (14) in a pop-up form, disposed almost opposite the tab (13), preventing the hanger arm (7) being dislodged from inside the tab (13) while moving (FIG. 8 and FIG. 9).

In the preferred embodiment of the present invention, the stopper (14) closes by stretching when pressed upon during emplacing the hanger arm (7) into the hanger (4) and thus allows the hanger arm (7) to be placed inside the tab (13). After the hanger arm (7) is placed into the tab (13) by passing the stopper (14), the stopper (14) gets free again when the force acting thereon is released and serves as a barrier preventing the hanger arm (7) to be dislodged from the tab (13).

The drawer (6) comprises:

a retainer (9) having at least one channel (15) wherein the drawer arm (8) is disposed slidably, a casing (10) shaped as a frame whereto the retainers (9) are secured, a carrier (11) having hooks (17) for suspending from the casing (10) by the two opposite sides, and at least one chamber (12) disposed on the carrier (11), the side walls thereof bearing against the casing (10) and wherein the items to be washed are emplaced (FIG. 4).

In an embodiment of the present invention, the channel (15) surrounds the drawer arm (8) (FIG. 11 and FIG. 12). In this embodiment, the drawer arm (8) is inserted into the channels (15) from one end. Afterwards, the hanger arm (7) is disposed into the tabs (13) on the hanger (5) from the open end and assembly is maintained (FIG. 4).

The dishwasher (1) furthermore comprises at least one lid (19) that covers the open ends of the hanger arm (7) and the drawer arm (8) for preventing the rail (7) being dislodged from inside the channel (15) and the tab (13) during the movement of the drawer (6) (FIG. 6, FIG. 7 and FIG. 9).

In the preferred embodiment of the present invention, the rail (5) is configured by bending a single wire in a U shape.

The open ends of the rails (5) preferably face the door (3). Accordingly, when it is wanted to remove the drawer (6) from the rails (5), first the lids (19) that cover the open ends of the rails (5) are displaced and afterwards the drawer arm (8) is removed from inside the channel (15) by pulling the drawer (6) forward. Thus, the drawer (6) can be entirely removed from the dishwasher (1) for purposes of cleaning etc.

In different embodiments of the present invention, the lid (19) comprises a protrusion (21) that clasps the hanger arm (7) and the drawer arm (8) from the sides and a recess (20) wherein the ends of the hanger arm (7) and the drawer arm (8) are seated (FIG. 6, FIG. 7 and FIG. 9).

In an embodiment of the present invention, the rail (5) comprises an extension (24) disposed at the open end of the hanger arm (7), extending to the side almost perpendicular to the hanger arm (7), that is seated in the recess (20) when the lid (19) is mounted. The extension (24) prevents the unwanted dislodging of the lid (19) when the drawer (6) is pulled forward to the end limit and makes the connection of the lid (19) with the rail (5) more durable.

The retainer (9) furthermore comprises at least one housing (18) that enables thereof to be fitted on the casing (10) (FIG. 10, FIG. 11 and FIG. 12).

In the preferred embodiment of the present invention, the casing (10) is made up of wires. In this embodiment, the housing (18) enables the retainer (9) to be secured on the casing (10) by at least partially clasping one of the wires forming the casing (10). The housing (18) is preferably seated on the casing (10) by close fitting (FIG. 10, FIG. 11 and FIG. 12).

In an embodiment of the present invention, the housing (18) is configured such that the wire forming the casing (10) can easily be inserted but not easily dislodged and is made from a plastic material resilient enough for allowing this motion. Thus the casing (10) can be easily mounted on the housing (18) (FIG. 11 and FIG. 12).

The retainer (9) furthermore comprises at least one support (16) that supports the drawer arm (8) from below and guides the sliding motion of the drawer arm (8) inside the channel (15) and hence the rail (5) on the retainer (9). Thus, the sliding motion is maintained to be more balanced (FIG. 11 and FIG. 12).

In an embodiment of the present invention, the carrier (11) is configured by joining bent wires. The carrier (11) comprises more than one wire placed lengthwise that traverses from end to end the base and the chamber (12) side walls with hooks (17) at the ends, and widthwise placed wires extending between the lengthwise placed wires on the base that support the chamber (12) disposed thereon (FIG. 15). The chamber (12) is suspended from the casing (10) by means of the carrier (11) to be easily removable. Accordingly, the user is enabled to take out the chamber (12) out of the dishwasher easily and then to replace it again.

In the preferred embodiment of the present invention, the chamber (12) is formed like an open-top box produced of plastic. The base of the chamber (12) is configured to be perforated and wavy for aiding the drying process of the items emplaced therein. The chamber (12) comprises nail-like fins (23) preferably extending from the base upwards. The fins (23) maintain orderly storing of cutlery items placed in the chamber (12) by supporting from both sides, thus enabling effective utilization of the interior volume of the chamber (12) (FIG. 4, FIG. 13 and FIG. 14).

In this embodiment, the chamber (12) comprises at least one lock (22) disposed on the chamber (12) side walls that secures chamber (12) after placing on the carrier (11). Accordingly, the chamber (12) is prevented from wobbling on the carrier (11) during the movement of the drawer (6) (FIG. 4, FIG. 13 and FIG. 14).

In a version of this embodiment, the chamber (12) comprises more than one lock (22). The locks (22) are curved to at least partially clasp one of the carrier (11) wires, with their sides facing the wire being open. The open sides of the of the locks (22) face the same direction and the carrier (11) wire is fitted into the lock (22) by sliding in this direction after the chamber (12) is placed on the carrier (11). Thus, the chamber (12) can be easily secured to the carrier (11) (FIG. 13 and FIG. 14).

Since the drawer (6) enables placing of cutlery items, a separate cutlery basket is not used in the dishwasher (1) thereby saving space.

It is to be understood that the present invention is not limited to the embodiments disclosed above and an expert in the technique can easily introduce different embodiments. These should be considered within the scope of the protection postulated by the claims of the present invention.

The invention claimed is:

1. A dishwasher (1) that comprises a body (2), a door (3) allowing access into the body (2), at least two hangers (4) completely secured oppositely on the ceiling (T) of the body (2), at least one rail (5) mounted to the hangers (4) and at least one drawer (6) secured to the rails (5) from the opposite sides to be movable thereon, wherein the items to be washed are emplaced, and characterized by rails (5) shaped like a decumbent U having a hanger arm (7), secured to the hanger (4), extending parallel to the ceiling (T) from the front to the rear and enables the rail (5) to move back and forth on the hanger (4) and a drawer arm (8) extending parallel to the hanger arm (7) in the same direction whereon the drawer (6) is mounted and enabling the drawer (6) to move to and fro in the rail (5), wherein the drawer (6) comprises at least one retainer (9) having at least one channel (15) wherein the drawer arm (8) is disposed slidably, at least one casing (10) shaped as a frame whereto the retainers (9) are secured, at least one carrier (11) forming the base of the casing (10), having hooks (17) for suspending from the casing (10) by the two opposite sides, and —at least one chamber (12) disposed on the carrier (11), the side walls thereof bearing against the casing (10) and wherein the items to be washed are emplaced.

2. The dishwasher (1) as in claim 1, characterized by at least one lid (19) that covers the open ends of the hanger arm (7) and the drawer arm (8).

3. The dishwasher (1) as in claim 2, characterized in that the lid (19) comprises a protrusion (21) that clasps to hold the hanger arm (7) and the drawer arm (8) from the sides and a recess (20) wherein the ends of the hanger arm (7) and the drawer arm (8) are seated.

4. The dishwasher (1) as in claim 3, characterized in that the rail (6) comprises an extension (24) disposed at the open end of the hanger arm (7), extending to the side almost perpendicular to the hanger arm (7) that is seated in the recess (20) when the lid (19) is mounted.

5. The dishwasher (1) as in claim 1, characterized in that the retainer (9) comprises at least one housing (18) enabling thereof to be fitted on the casing (10).

6. The dishwasher (1) as in claim 5, characterized in that the casing (10) being made up of wires and the housing (18) enabling the retainer (9) to be secured on the casing (10) by at least partially clasping one of the wires.

7. The dishwasher (1) as in claim 5 or 6, characterized in that the housing (18) being mounted on the casing (10) by close fitting.

8. The dishwasher (1) as in claim 1, characterized in that the retainer (9) comprises at least one support (16) that supports the drawer arm (8) from below and guides the sliding motion of the drawer arm (8) and hence the rail (5) on the retainer (9).

9. The dishwasher (1) as in claim 1, characterized in that the carrier (11) configured by joining bent wires, comprises more than one wire placed lengthwise that traverses from end to end the base and the chamber (12) side walls with hooks (17) at the ends and widthwise placed wires extending between the lengthwise placed wires on the base supporting the chamber (12) disposed thereon.

10. The dishwasher (1) as in claim 1, characterized in that the chamber (12) is produced of plastic and shaped like an open-top box.

11. The dishwasher (1) as in claim 1, characterized in that the chamber (12) comprises at least one lock (22) disposed on the side walls, for securing the chamber (12) after placing on the carrier (11).

* * * * *